US005154019A

United States Patent [19]

Day

[11] Patent Number: 5,154,019

[45] Date of Patent: Oct. 13, 1992

[54] TRIMLESS DOOR FRAME

[76] Inventor: Robert L. Day, 9990 Edmore Pl., Sun Valley, Calif. 91352

[21] Appl. No.: 770,233

[22] Filed: Oct. 3, 1991

[51] Int. Cl.[5] ..... E06B 1/04

[52] U.S. Cl. ..... 49/504; 49/506; 52/211

[58] Field of Search ..... 49/504, 506; 52/211, 52/212, 213, 214, 215

[56] References Cited

U.S. PATENT DOCUMENTS

| | | | |
|---|---|---|---|
| 3,107,759 | 10/1963 | Day et al. | 52/212 |
| 3,654,731 | 4/1972 | Jelliner | 49/504 |
| 4,034,514 | 7/1977 | Cecil | 49/504 |
| 4,094,112 | 6/1978 | Smith et al. | 52/211 |
| 4,154,034 | 5/1979 | Bursk et al. | 49/504 X |
| 4,719,729 | 1/1988 | Wynar | 52/211 |

*Primary Examiner*—Philip C. Kannan
*Attorney, Agent, or Firm*—Fred Flam; Flam & Flam

[57] ABSTRACT

A prefabricated door frame includes two vertical frame elements and a header element, each of channel shaped configuration with side flanges encompassing the wall at the edges of a wall opening. One of the vertical frame elements is secured by the aid of threaded fasteners passing through the jamb face of the frame element and into the rough frame member. Heads of the fasteners prevent movement of the frame element away from the rough frame member. After appropriate adjustment to plumb the frame element, cover plates are attached to the jamb face and overlie the screw heads thus to secure the frame element in its adjusted position. The header and other vertical frame element are positioned by the aid of registry clips inserted at the ends of the header element and the upper ends of the vertical frame elements. A jack screw captured behind the stop of the other vertical frame element reacts against the rough frame member to clamp the header element in place and thus determine the nominal spacing of the vertical frame elements. Another threaded fastener passes through the jamb face of the other frame element and into the rough frame member. The head of this fastener is clamped by a cover plate and thus secures the other vertical frame element in position.

7 Claims, 4 Drawing Sheets

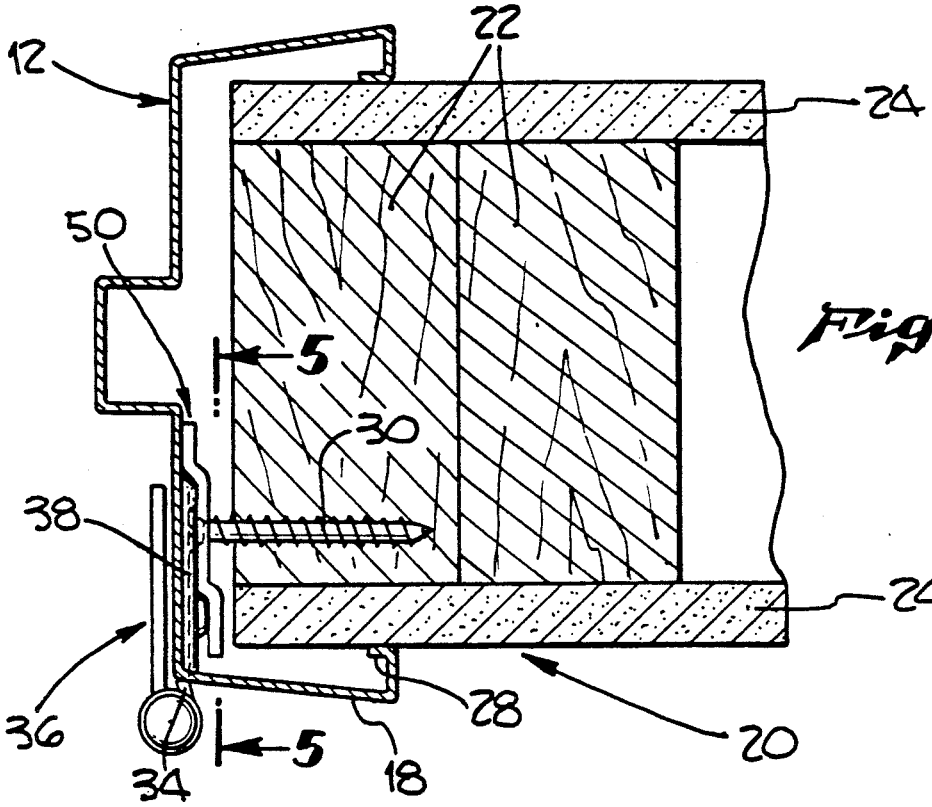
Fig. 4.
Fig. 5.
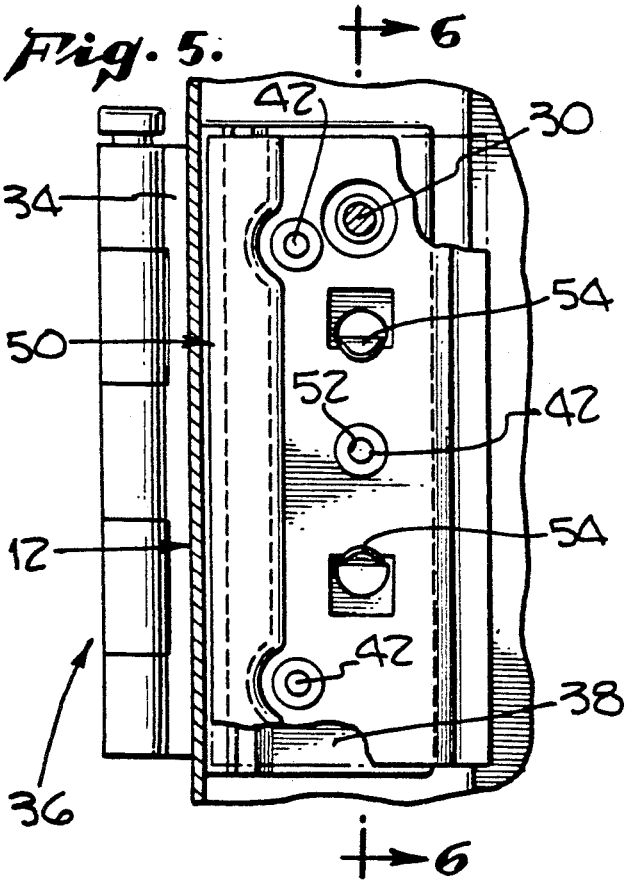
Fig. 6.
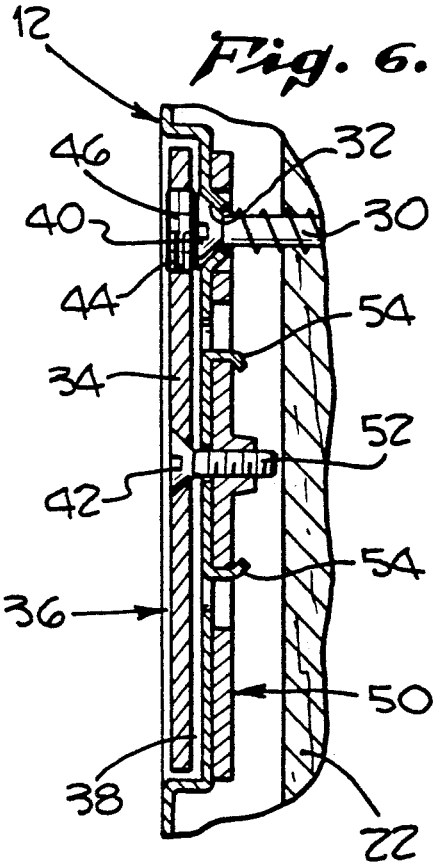

Fig. 8.
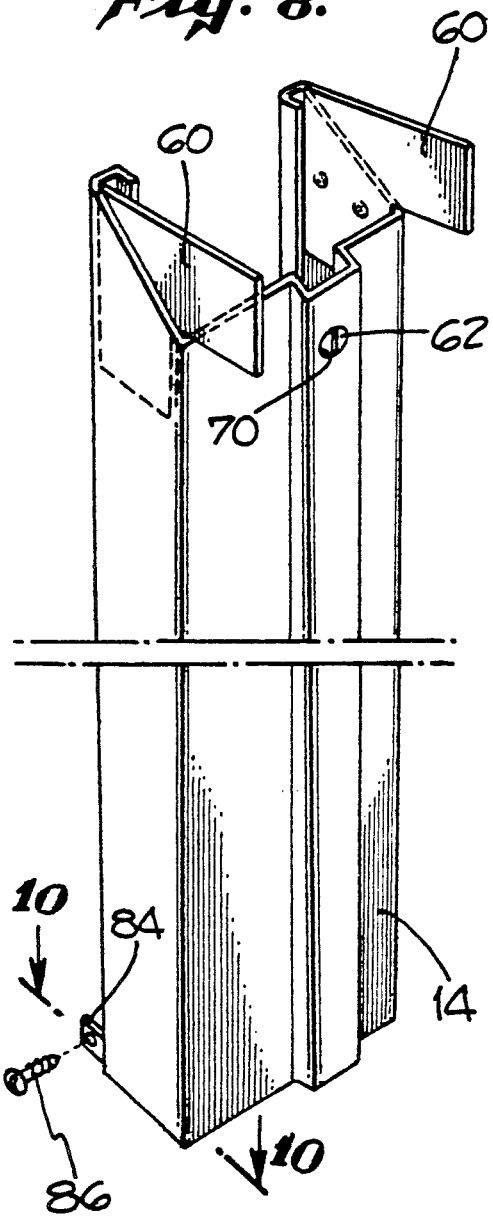
Fig. 9.
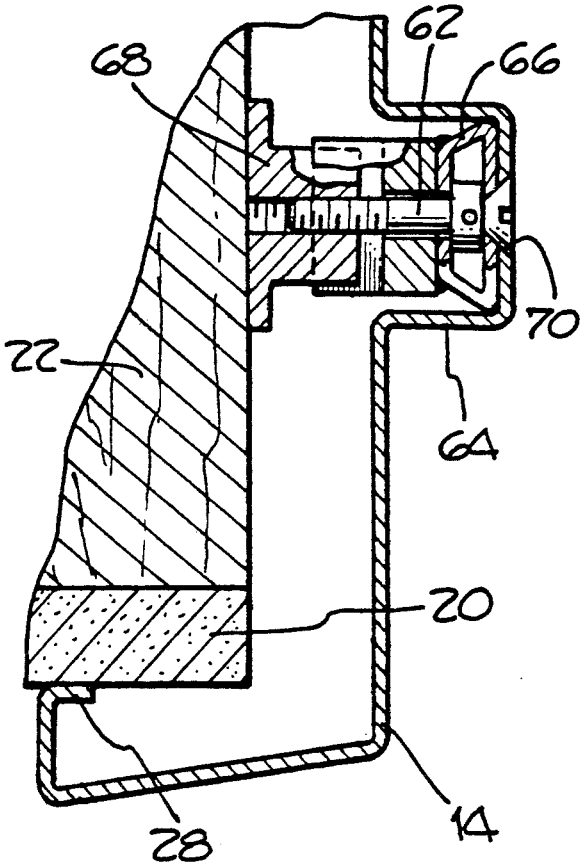
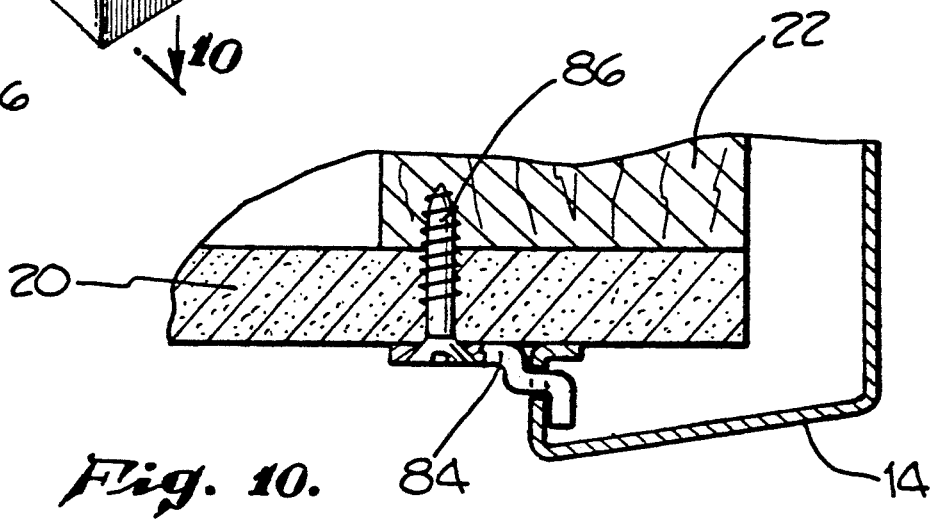
Fig. 10.

TRIMLESS DOOR FRAME

FIELD OF INVENTION

This invention related to metal door frames such as shown in U.S. Pat. No. 3,107,759 issued Oct. 22, 1963 to Robert L. Day and Harry L. Williams, entitled PREFABRICATED DOOR FRAME AND MOLDING STRUCTURE, and in U.S. Pat. No. 4,094,112 issued Jun. 13, 1978 to Robert L. Day entitled METAL DOOR FRAME AND TRIP CLIP.

BACKGROUND AND OBJECTS OF THE INVENTION

The metal door frame structures shown and described in said prior patents include three channel shaped frame element, one for each side of the wall opening, and one for the top. The flanges at opposite sides of the jamb embrace the wall at the edge of the opening. After careful leveling and adjustment to ensure proper orientation and spacing of the jambs, the frame elements are secured by nailing the flanges to the underlying structure.

In order to conceal the fasteners and the raw edges of the flanges, trim pieces are snapped in place over clips attached to, or forming a part of the flanges. Unless the clips are precisely located, the trim pieces will not fit properly. Moreover, proper longitudinal positioning of the trim pieces requires a good deal of care and attention.

An object of the present invention is to provide a metal door frame that provides a neat and finished appearance without requiring any trim pieces. A companion object of the present invention is to provide a metal door frame that is extremely simple in construction and simple to install. Still another object of the present invention is to provide a prefabricated door frame, the vertical elements of which are securely fastened about the wall opening by utilizing means located at the jamb face of the frame elements rather than at the side flanges thereof.

Companion objects of the present invention are to provide a preformed three elements door frame structure that is easily installed, and to provide a simple method for installing a prefabricated door frame structure.

SUMMARY OF INVENTION

In order to accomplish the foregoing objective, I provide a frame structure that is attached by fasteners passing through the jamb face of the frame elements and parallel to the wall, rather than through the side flange at right angles to the wall. The fasteners are heavy duty screws, the heads of which prevent movement of the frame elements in one direction; cover plates attached to the jamb face overlie the screw heads and thus limit movement of the frame elements in the opposite direction.

The three elements of the door frame structure comprise two vertical frame elements and a header element. One vertical frame element is a hinge frame element and the other is a latch frame element. After the hinge frame element is leveled or plumbed and secured by fasteners, a simple jack screw arrangement carried near the top of the latch frame element clamps the header element in place, establishing the proper spacing between the vertical frame elements. Thereupon one or more additional fasteners are provided beneath the jack screw to complete the installation.

In practice, the hinges and latch strikes serve as cover plates for the fastener screws, thereby providing a concealed and neat appearance.

BRIEF DESCRIPTION OF THE DRAWINGS

A detailed description of the invention will be made with reference to the accompanying drawings wherein like numerals designate corresponding parts in the several figures. These drawings are true scale.

FIG. 4 an enlarged transverse sectional view taken along the plane corresponding to line 4—4 of FIG. 1 and showing a frame element fastener at the region of a hinge.

FIG. 5 is a sectional view taken along a plane corresponding to line 5—5 or FIG. 4.

FIG. 6 is a transverse sectional view taken along a plane corresponding to line 6—6 of FIG. 5.

FIG. 8 is a pictorial view of the latch frame element by itself, showing the lugs that interconnect the vertical frame elements to the header element.

FIG. 9 is a sectional view taken along the plane indicated by line 9—9 of FIG. 1, and showing the jack screw structure.

FIG. 10 is a fragmentary sectional view taken along a plane corresponding to line 10—10 of FIG. 8.

DETAILED DESCRIPTION

The following detailed description is of the best presently contemplated mode of carrying out the invention. This description is not to be taken in a limiting sense, but is made merely for purposes of illustrating the general principles of the invention, the scope of the invention being defined by the appended claims.

Figure 1:
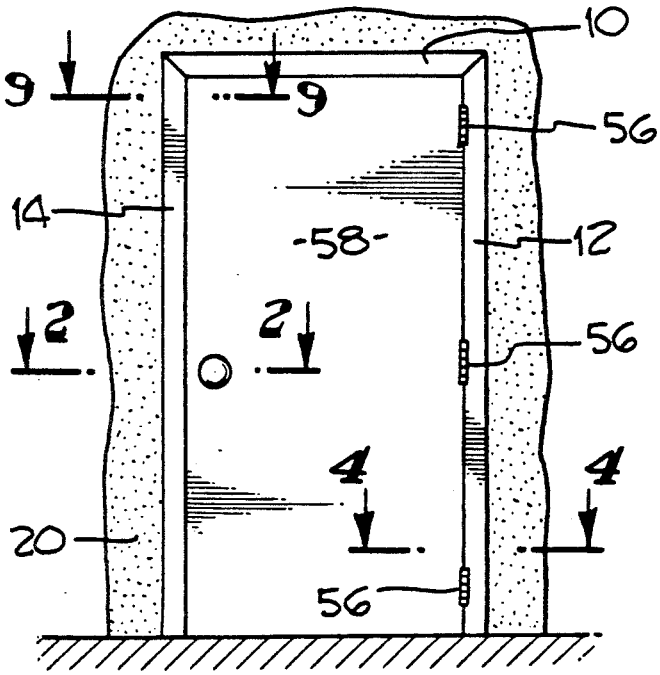
FIG. 1 is a front elevational view of a door frame incorporating the present invention installed at a door opening.

The prefabricated door frame shown in FIG. 1 comprises three one piece elements, a header element 10, a hinge frame element 12 and a latch frame element 14 that fit about the edges of a wall opening. The side edges of the wall opening are defined typically by vertical frame members 22 and dry wall board material 24. The vertical frame members 22 in this instance are standard wood 2"×4"s and the board material 24 in this instance is paper clad sheet gypsum.

The hinge frame element 14 as shown in FIG. 4 has a generally channel shaped cross-sectional configuration. Its side flanges 16 and 18 together encompass the wall 20 at one side of the opening to be framed. The end edges 26 and 28 of the flanges 16 and 18 are returned and thus concealed. The surfaces of the flanges 16 and 18 in the present slant slightly to simulate the configuration of typical trim molding structures. The surfaces of the flanges are unmarred. No fasteners extend through the flanges. Consequently no separate trim structure need be applied to conceal fasteners.

Figure 7:
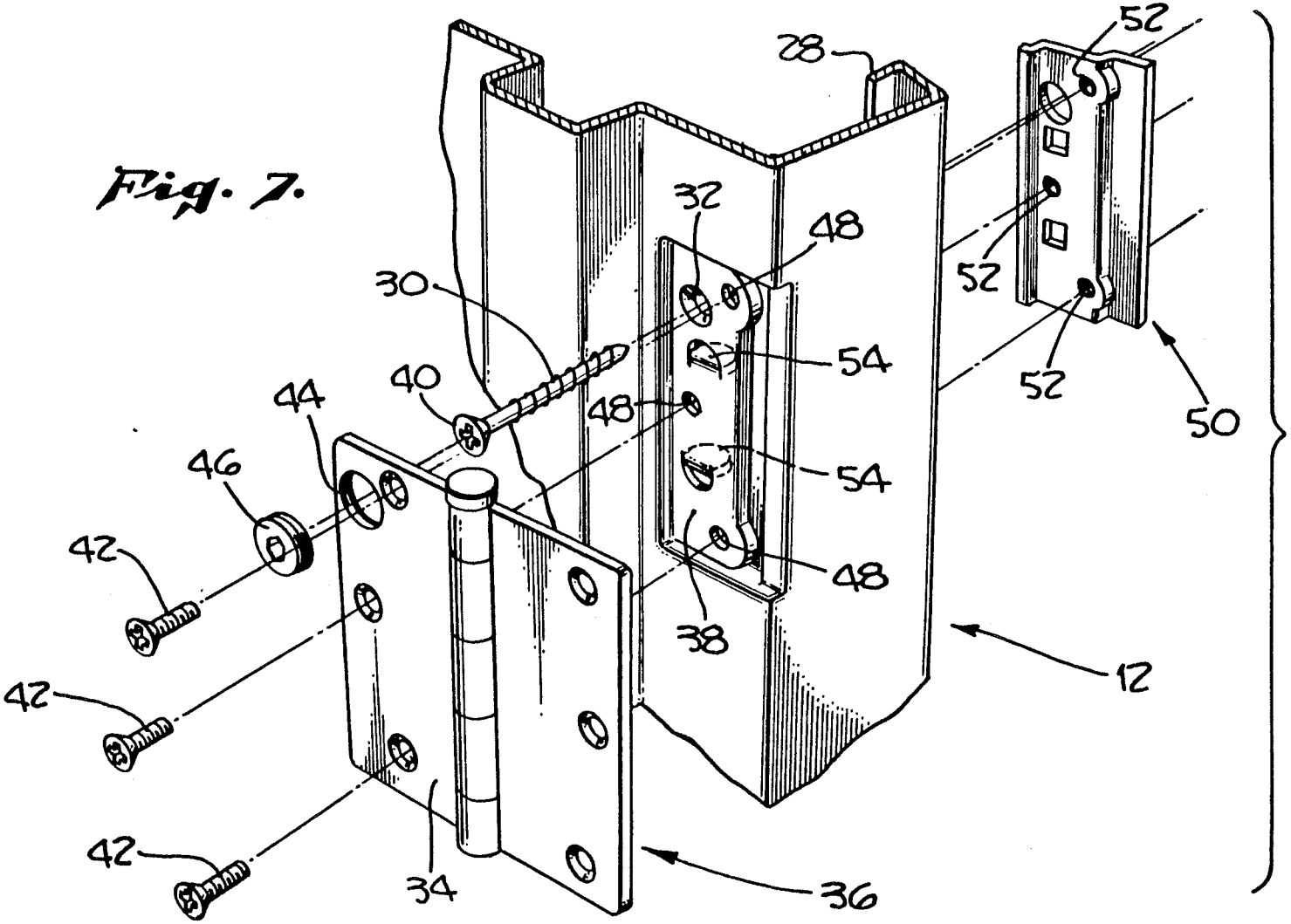
FIG. 7 is an exploded pictorial view showing the fastener structure of FIGS. 4, 5 and 6.

In order to make it possible for the flanges 16 and 18 to serve as finished elements, the jamb frame element 12 is secured by screw fasteners 30 that extend through the jamb face of the frame element 12 and into at least one of the rough frame members 22. One of the screw fasteners 30 is shown clearly in FIG. 7. The screw passes through a chamfered hole 32 located in a shallow recess or depression 38 in the jamb face sized to accommodate one leaf 34 of a door hinge 36. The flat head 40 of the screw fastener 30 fits flush in the hole 32 and when secured to the rough frame member prevents the jamb element 12 from moving in one direction into the wall opening.

To prevent the frame element 12 from moving in the opposite direction, thereby to fix the frame element 12 in position, the screw fastener head 40 is clamped to the hole 32. This is conveniently achieved by the hinge lead 34 which is fastened in the recess 38 by a series of screws 42. In this instance the hinge leaf 34 serves as a cover plate for the screw fastener 30.

Since adjustment of the screw fastener 30 may be required after the hinges are in place and after the door is hung, the hinge leaf has an access hole 44 closed by a threaded plug 46. The hole 44 is sufficiently large to accommodate a screw driver for engagement with the screw fastener head 40 for adjustment without removing the hinge itself. The plug 46 also takes up any slack that may occur between the hinge leaf 34 and the fastener head 40.

Holes 48 that receive the screws 42 that attach the hinge leaf could be tapped. It is more cost effective to punch the holes and provide a small backing plate 50 that registers with the inside surface of the frame element 12. This small backing plate is more easily handled for providing tapped holes 52 for attachment of the hinge leaf 34. The backing plate 50 is secured in registry by locking tabs 54 struck from the material at the bottom of the shallow recess 38.

As shown in FIG. 1, there are three hinges 56 for the door 58. Each is provided with a screw fastener 30. By proper adjustment of the screw fasteners, the jamb element 12 is leveled precisely. Thereafter, the head element 10 is positioned. This element is miter cut at its end to fit correspondingly cut top ends of the opposite frame elements 12 and 14. As shown in FIG. 8, clips 60 fit in the mitered ends of the meeting frame elements for proper fitting.

The header element requires no separate fasteners. It is simply clamped in place between the jamb frame and latch frame elements. For this purpose a jack screw arrangement is provided as shown in FIGS. 8 and 9. A jack screw 62 is captured inside and near the top of the stop 64 of the latch frame element 14. For this purpose a bracket 66 is welded inside the stop. It has a hole through which the jack screw extends. The screw carries a block 68 that is forces against the wood frame member 22 as the screw is turned. The screw head is accessible for turning through an access hole 70. After the frame elements are connected by clips 60, the jack screw is operated until the latch frame element moves outwardly to take up whatever clearance exists at the corners between the frame elements. Since the header is carefully sized, the correct spacing results at the top of the frame for accommodating the door.

Figure 2:
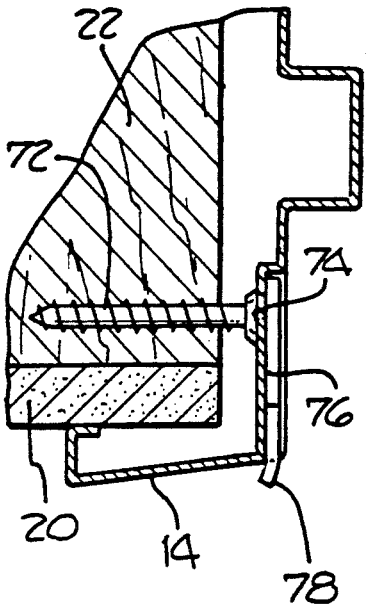
FIG. 2 is an enlarged sectional view showing a frame element fastener at the region of the latch strike, adjacent parts being broken away.
Figure 3:
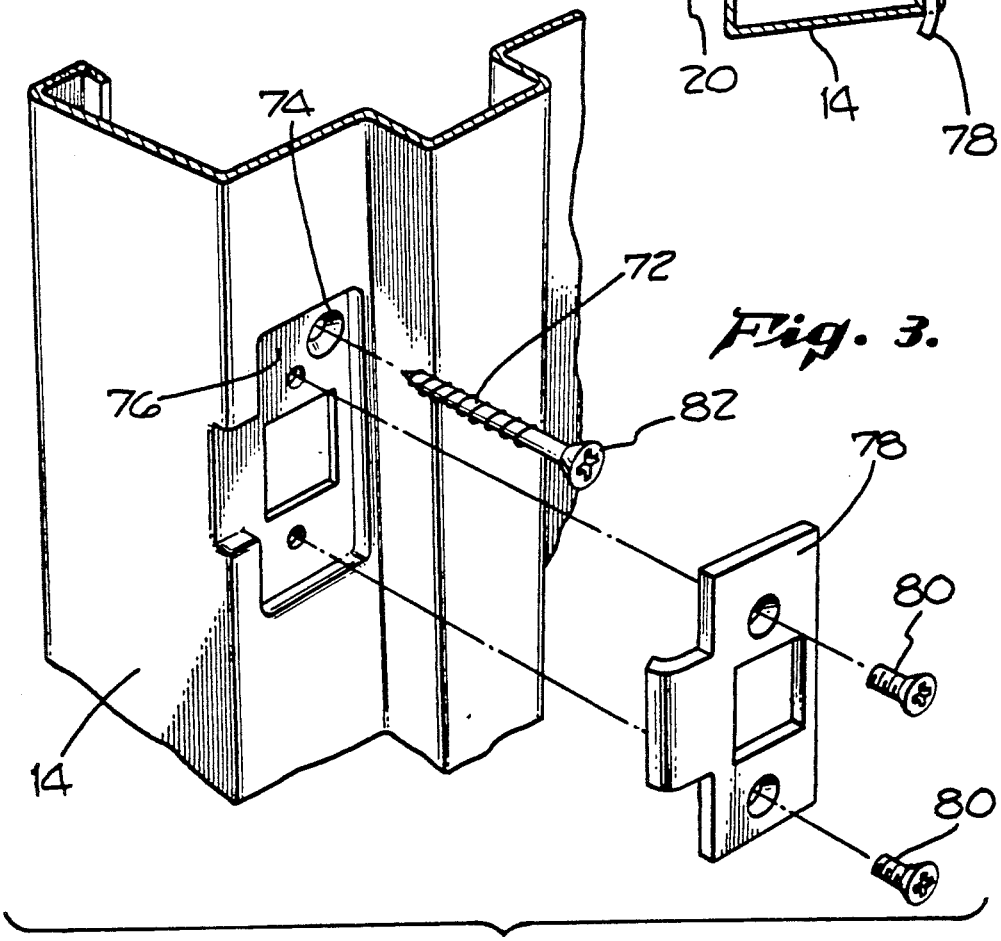
FIG. 3 is an exploded pictorial view showing the fastener structure of FIG. 2.

Once the top of the latch frame element is properly positioned, the lower portions are fixed in prior place. For this purpose, yet another screw fastener 72 is provided as shown in FIGS. 2 and 3. The screw fastener 72 operates in essentially the same manner as the screw fasteners 30 for the hinge frame element 12. In the present instance, however, the screw fastener 72 passes through a chamfered hole 74 in a shallow recess 76 designed to accommodate the latch strike plate 78. When the strike plate 78 is attached, as by screws 80, the head 82 of the fastener 72 is captured and the position of the strike frame element 14 accurately set. In this instance the strike plate 78 serves as the cover plate for the screw fastener 72.

A screw 86 passing through an anchor tab 84 (FIGS. 9 and 10) secures the lower end of the strike frame element 14 to the bottom plate (not shown) of the wall structure. The tab interfits the frame in a manner shown in FIG. 10.

The preformed metal frame structure is easily installed. No separate trim elements are required. The structure is sturdy and adequately supports the installed door.

Intending to claim all novel, useful and unobvious features and combinations of features shown and/or described, I claim:

1. A prefabricated door frame element for use in combination with rough frame members forming an opening in a wall;

(a) said door frame element having a substantially channel shaped cross sectional configuration with finished side flanges together encompassing said wall at one side of said wall opening;

(b) said door frame element having a jamb face joining said flanges;

(c) a screw fastener extending through said jamb face and threadedly engaging the corresponding rough frame members, said screw fastener having a head engaging said jamb face and limiting movement of said door frame element away from said rough frame member; and (d) a cover plate clamping the head of the screw against said jamb face thereby limiting movement of said door frame element toward said rough frame member;

(e) said door frame element being secured in adjusted position relative to said wall opening thereby obviating fasteners extending through said flanges.

2. The combination as set forth in claim 1 in which said cover plate is a latch strike.

3. The combination as set forth in claim 1 in which said cover plate is one leaf of a door hinge.

4. The combination as set forth in claim 3 together with a threaded plug closing an opening in said hinge leaf and removable for providing access to the head of said screw fastener for adjustment without removing the entire hinge leaf.

5. A prefabricated door frame element for use in combination with rough frame members forming an opening in a wall;

(a) said door frame element having a substantially channel shaped cross sectional configuration with finished side flanges together encompassing said wall at one side of said wall opening;

(b) said door frame element having a jamb face joining said flanges; said jamb face having a door stop and a shallow recess adjacent said stop for accommodating a leaf of a door hinge;

(c) a screw fastener extending through said jamb face at said shallow recess and threadedly engaging the corresponding rough frame member, said screw fastener having a head engaging said jamb face and limiting movement of said door frame element away from said rough frame member; and (d) a door hinge having a lead accommodated in said recess and clamping the head of the screw against said jamb face thereby limiting movement of said door frame element toward said rough frame member;

(e) said door frame element being secured in adjusted position relative to said wall opening thereby obviating fasteners extending through said flanges.

6. The combination as set forth in claim 5 together with a threaded plug closing an opening in said hinge leaf and removable for providing access to the head of said screw fastener for adjustment without removing the hinge leaf.

7. A method of installing a trimless prefabricated door frame in a wall opening formed by rough frame members, said door frame including a pair of vertical frame elements and a header element, each element having a substantially channel shaped cross sectional configuration with finished side flanges, and each element having a jamb face connecting said side flanges:

(a) positioning one of the vertical frame elements at one side of said openings;

(b) installing two screw fasteners through vertically spaced holes in the jamb face of said one frame element and therewith engaging the corresponding rough frame member so that the heads of said screw fasteners stop movement of said frame elements away from its rough frame member;

(c) securing cover plates over said heads of said screw fasteners after said screw fasteners are adjusted to plumb said one vertical frame element;

(d) placing the head element and the other vertical frame element at said opening with the aid of clips fitting the ends of said header element and the upper ends of said vertical frame elements;

(e) jacking the upper end of said other vertical frame element away from its corresponding rough frame member by the aid of a jack screw captured behind the jamb face of said other vertical frame element until the header element is tightly clamped between said vertical frame elements thereby to achieve the nominal spacing between said vertical frame elements;

(f) thereafter installing a third screw fastener through a hole in the jamb face of said one frame element and therewith engaging the corresponding rough frame member so that the heads of said screw fasteners stop movement of said one frame element away from its rough frame member;

(g) securing a cover plate over the head of said third screw fastener after it is adjusted to plumb said other vertical frame element.

* * * * *